US006965065B2

(12) United States Patent
McPherson

(10) Patent No.: US 6,965,065 B2
(45) Date of Patent: Nov. 15, 2005

(54) NECK FOR STRINGED MUSICAL INSTRUMENT

(76) Inventor: Mathew McPherson, 19055 Incline Rd. P.O. Box 58, Norwalk, WI (US) 54648

( * ) Notice: Subject to any disclaimer, the term of this patent is extended or adjusted under 35 U.S.C. 154(b) by 168 days.

(21) Appl. No.: 10/304,731

(22) Filed: Nov. 26, 2002

(65) Prior Publication Data

US 2003/0106409 A1 Jun. 12, 2003

Related U.S. Application Data

(60) Provisional application No. 60/339,857, filed on Dec. 12, 2001.

(51) Int. Cl.[7] ..... G10D 3/00
(52) U.S. Cl. ..... 84/293
(58) Field of Search ..... 84/293, 290, 267

(56) References Cited

U.S. PATENT DOCUMENTS

| | | | | | |
|---|---|---|---|---|---|
| 4,084,476 | A | * | 4/1978 | Rickard | 84/293 |
| 4,121,492 | A | | 10/1978 | Berardi et al. | 84/293 |
| 4,304,277 | A | | 12/1981 | Petillo | 144/316 |
| 4,681,009 | A | | 7/1987 | Mouradian | 84/293 |
| 4,846,038 | A | | 7/1989 | Turner | 84/293 |
| 4,846,039 | A | | 7/1989 | Mosher | 84/293 |
| 4,877,070 | A | | 10/1989 | Hyashi | 144/364 |
| 5,018,423 | A | | 5/1991 | Bunker et al. | 84/293 |
| 5,337,644 | A | | 8/1994 | Fishman et al. | 84/314 |
| 5,779,128 | A | * | 7/1998 | Szczerba | 227/113 |
| 5,864,073 | A | * | 1/1999 | Carlson | 84/293 |
| 5,990,396 | A | | 11/1999 | Lasner | 84/293 |
| 6,051,765 | A | | 4/2000 | Regenberg et al. | 84/293 |
| 6,100,458 | A | | 8/2000 | Carrington et al. | 84/293 |
| 6,111,175 | A | | 8/2000 | Lasner | 84/293 |

* cited by examiner

*Primary Examiner*—Kimberly Lockett
(74) *Attorney, Agent, or Firm*—Vidas, Arrett & Steinkraus

(57) ABSTRACT

A neck assembly for a stringed musical instrument, the neck assembly comprising a finger board having a certain length, an inner surface and an outer surface and a neck portion having a certain length, an inner surface and another surface, the neck assembly further comprising an elongated carbon insert positioned between the finger board and the neck portion substantially along their lengths.

11 Claims, 6 Drawing Sheets

34
30
26

30
26
4
4
24
28
15
36
25

NECK FOR STRINGED MUSICAL INSTRUMENT

Thie present application claims priority to U.S. Provisional Application 60/339,857 filed Dec. 12, 2001, which is herein incorporated by reference in its entirety.

FIELD OF THE INVENTION

This invention relates to the neck structure of a stringed musical instrument, and more particularly to a neck structure having a carbon fiber insert along its length. The configuration provides strength and durability without the need for an adjustable mechanism to adjust the neck.

BACKGROUND OF THE INVENTION

A typical acoustic guitar has a hollow body or sound box connected to a neck. The hollow body has a soundboard with a sound hole, a back or bottom board spaced from the soundboard, and a shaped side wall which connects between the soundboard and backboard.

The acoustic guitar has a series of strings strung at substantial tension from a bridge on the soundboard, across a portion of the soundboard, and along the neck. The string tension creates forces which act on the neck and the soundboard and which, over time, can cause bending, cracking or other damage. The damage can result in structural failure and altered intonation of the acoustic guitar. Methods of compensating for these factors have been employed in the past.

Traditionally, necks of stringed instruments have been made of wood. Wooden necks, however, tend to bend and warp under the load imposed on them by the tension of the strings, due to exposure to temperature or humidity variations, or due to aggressive playing styles. In attempts to alleviate these inherent problems, prior art wooden neck constructions have incorporated truss rods, or other additional structural elements, within the neck to bear some of the load exerted on the neck by the strings. Prior art neck constructions have also incorporated separate adjustment mechanisms to correct any warping or bending which has already occurred.

One such prior art neck construction is shown in U.S. Pat. No. 5,018,423. This patent discloses a neck construction which includes a metal rod within a wooden neck which extends from the base of the peg head to the body of the stringed instrument. This rod functions as a truss rod for adjusting the vertical space between the strings and the neck, or, in other words, for adjusting the position of the fingerboard and the neck structure relative to the plane of the strings (otherwise known as relief adjustment) to suit user preferences. The rod also functions as a structural element which bears most of the load exerted on the neck by the strings. The neck structure also includes an additional device for rotatably adjusting the neck to compensate for any bending or warping which may occur.

Neck compositions of this type do reduce stress induced deformation of the wooden neck, but are limited in their effectiveness. Any neck in which wood is a structural element will inevitably undergo a certain amount of deformation, be it due to string tension, humidity, temperature, or aggressive use. Devices such as that shown in U.S. Pat. No. 5,018,423 can only counteract and/or correct such deformations. Furthermore, since the rod serves as the relief adjustment mechanism as well as the primary load bearing element, its ability to make and maintain fine adjustments is limited.

Another prior art device which has used a structural reinforcement in a wooden neck is U.S. Pat. No. 4,304,277. This device provides two opposing reinforcing members separated by a spacer. Grip members are attached to each of the reinforcing members for the purpose of giving the instrument the physical look and feel of an instrument with a wooden neck. The reinforcing members, the spacer, and the grip members all cooperate to bear the load of the string tension. As with the device shown in U.S. Pat. No. 5,018,423, however, the grip members and spacer are structural members which will inevitably undergo deformation if made of wood.

Other prior art neck constructions have addressed the problems of warping and bending associated with wooden necks by replacing the wooden neck with a neck made of a composite material. For example, U.S. Pat. No. 4,846,039 discloses a solid single piece neck construction made of layers of epoxy resin and powdered carbon mixture, with longitudinally laid carbon fibers. A neck made of this material does not bend or warp, and is of sufficient strength to withstand the string tension without deforming, and without the need for additional structural reinforcement.

A significant disadvantage of composite necks, however, is that they have significantly different tonal properties than wooden necks. To many users who prefer the response and tonal coloration associated with traditional wooden necks, composite necks are unacceptable.

One prior art device disclosed in U.S. Pat. No. 4,121,492 has combined a forged aluminum reinforcing member with wooden or plastic inserts with the object of preserving the "desirable feel and appearance of wood or plastic materials". (Col. 1, lines 56–62).

Further prior art include U.S. Pat. No. 5,990,396, U.S. Pat. No. 6,111,175, U.S. Pat. No. 6,017,65, U.S. Pat. No. 4,877,070, U.S. Pat. No. 4,846,039, U.S. Pat. No. 4,681,009 and U.S. Pat. No. 6,100,458.

All US patents and applications all other published documents mentioned anywhere in this application are incorporated herein by reference in their entirety.

Without limiting the scope of the invention in any way, the invention is briefly summarized in some of its aspects below.

SUMMARY OF THE INVENTION

In accordance with these objectives, the present invention is directed to a stringed musical instrument with a neck assembly which provides superior strength and durability, yet which still retains the response and appearance associated with traditional wooden necks. Preferably, the stringed instrument has a body, a neck assembly with a neck portion, a finger board and a headstock portion, and strings which are anchored at one end to the body and at the other end under tension to the headstock portion of the neck assembly.

The neck assembly includes a carbon insert of very high strength enclosed between the finger board and the neck portion. The carbon insert is shaped to fit at least partially into the neck portion and extends substantially along the length of the neck portion. The insert provides superior strength to the neck assembly to prevent unwanted flexing.

DESCRIPTION OF THE PREFERRED EMBODIMENT

Figure 1:
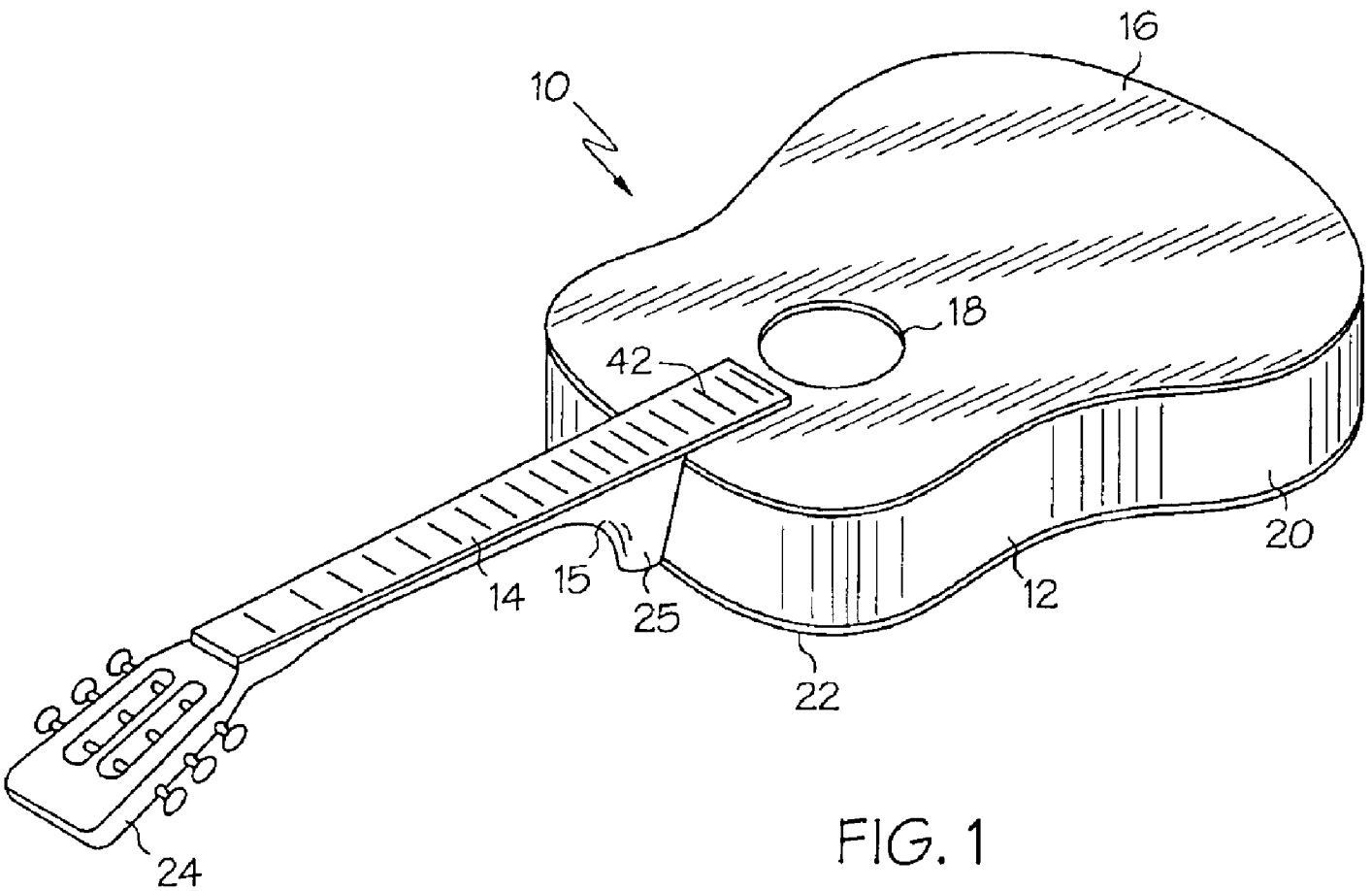
FIG. 1 is a perspective view of an acoustic guitar according to the invention.

While this invention may be embodied in many different forms, there are shown in the drawings and described in detail herein specific embodiments of the invention. The present disclosure is an exemplification of the principles of the invention and is not intended to limit the invention to the particular embodiments illustrated.

For the purposes of this disclosure, unless otherwise indicated, identical reference numerals used in different figures refer to the same component.

This invention relates to a neck for stringed instruments. For purposes of description, an acoustic guitar is used for illustrative purposes.

Referring now to the drawings, FIG. 1 illustrates an acoustic guitar 10 having a hollow body 12 and a neck 15 having a finger board or fret board 14. The body has a soundboard 16 with a sound hole 18. The soundboard 16 is connected to sidewall 20 which, in turn, is connected to a backboard 22. The neck 14 has a headstock 24, and strings (not shown) are strung from the headstock 24 in a direction along the neck 14, across the sound hole 18 and to a bridge (not shown) on the soundboard 16.

Figure 2:
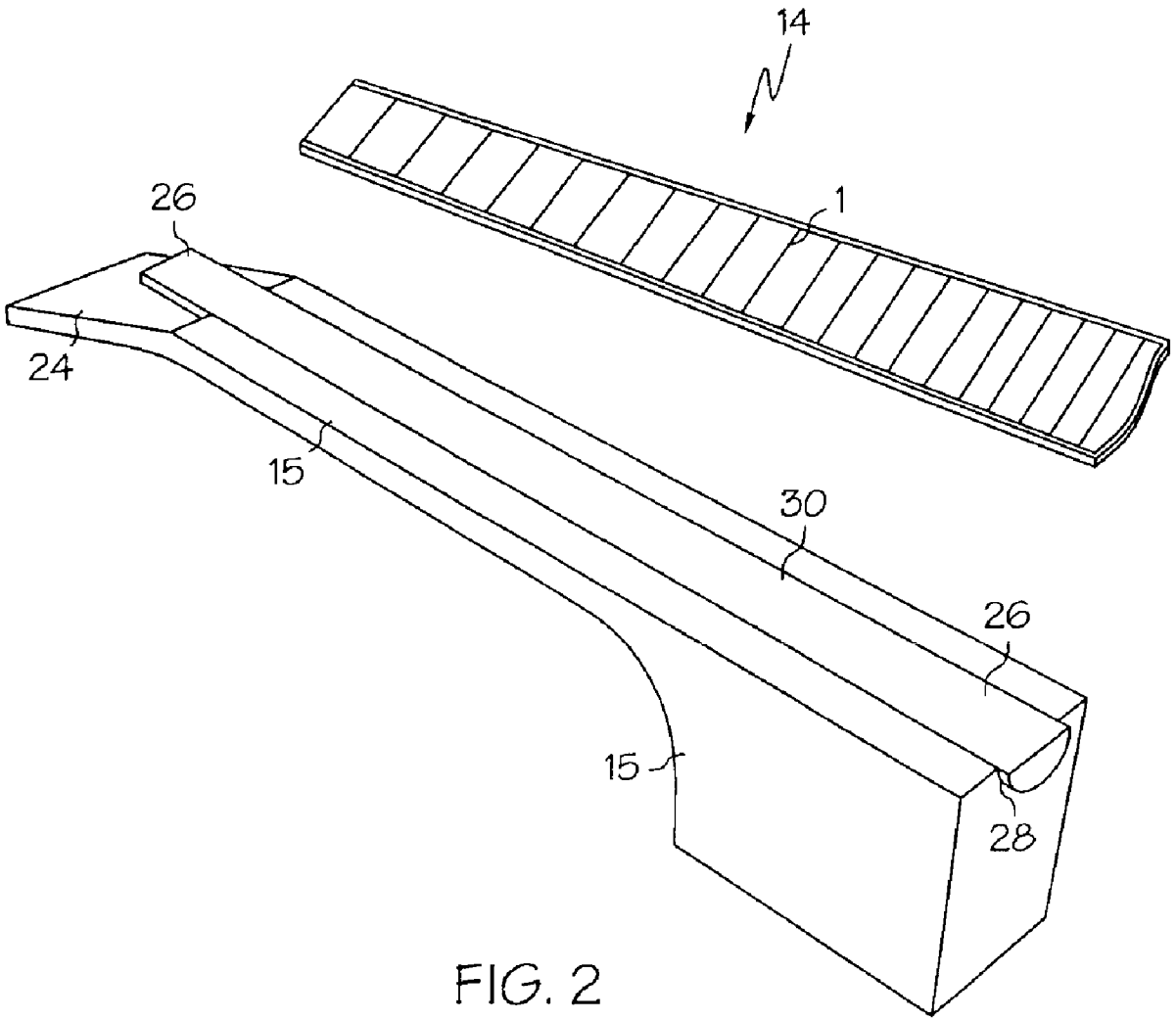
FIG. 2 shows an exploded perspective view of the neck assembly.

FIG. 2 shows the neck 15 with the finger board 14 having frets 17 removed. The neck 15 and headstock 24 are shown as a preformed block which has not yet been machined into the typical form of a guitar neck. Notwithstanding this, for purposes of the invention, the necessary aspects of the neck are shown.

The neck 15 has a groove 28 along its length to receive a carbon insert 26. The groove 28 in the shown embodiment is a semi-circle groove. The carbon insert 26 is shaped to conform to the groove and settles into the groove 28. The exposed surface 30 of the carbon insert 26 is suitably shaped to conform with the bottom 32 of the finger board 14. In the embodiment shown, the exposed surface 30 is flat. It should be understood that the exposed surface 30 may be slightly rounded to fit a corresponding groove in the underside of the finger board 14 for a smooth fit, or vice versa.

The substantially semi-circular shape of the insert 26 provides optimum stiffness with a conventional neck profile. This shape allows the adhesive to displace any air. The insert may extend as near to full length of the neck as possible to provide optimum strength to the entirety of the neck.

Figures 3, 4:
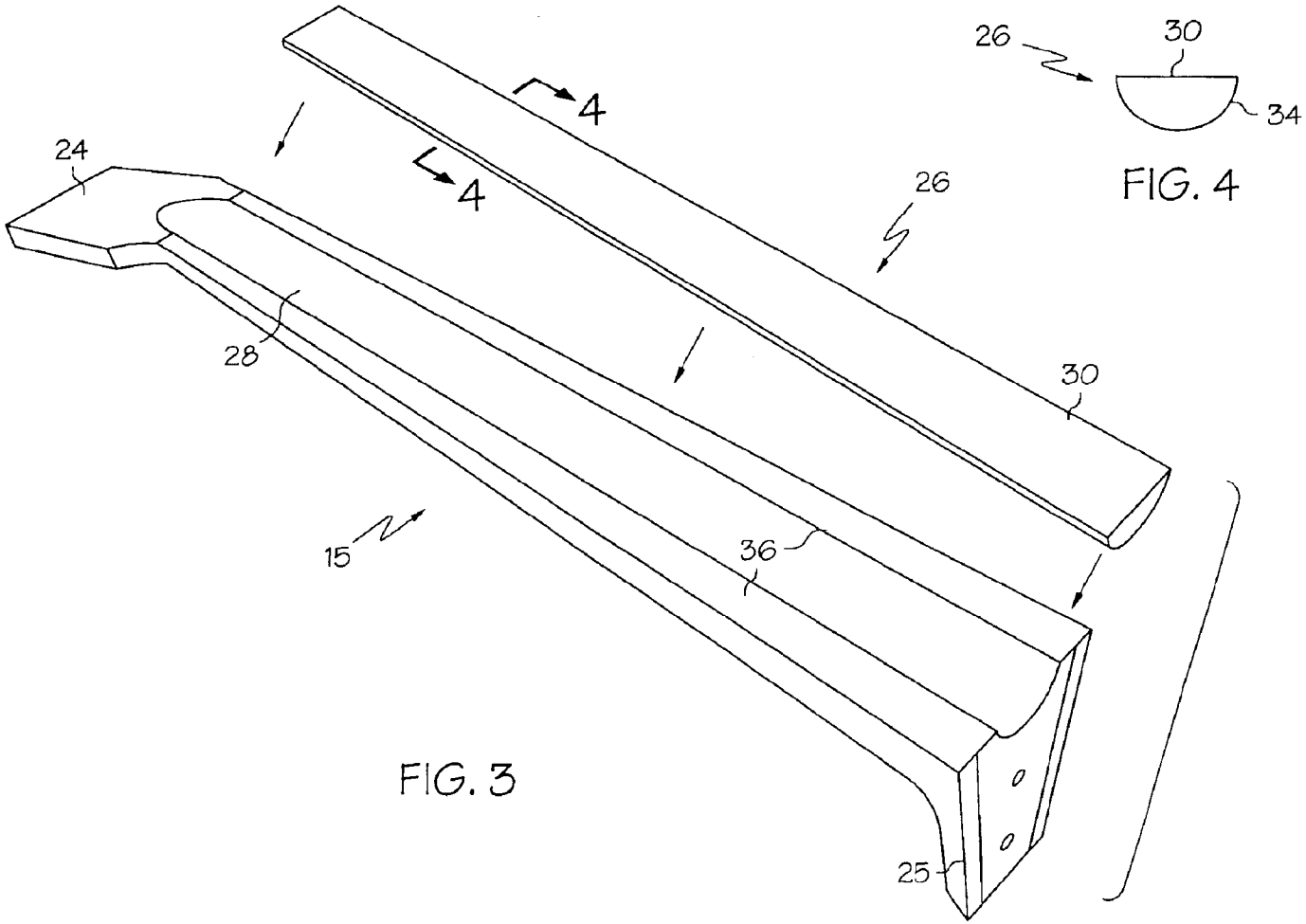
FIG. 3 shows a partial exploded perspective view of the neck assembly.
FIG. 4 is a cross-sectional view of the carbon insert.

FIG. 3 illustrates a machined neck 15 having a more convention shape. In this figure, one can better visualize the headstock 24 and the connection brace portion 25, which allows the neck 15 to be attached to the sound box. In this particular figure, the carbon insert 26 is removed to expose the neck groove 28. As can be seen, the groove 28 is rounded to receive the rounded bottom 34 of the insert 26 for a uniform, smooth fit. FIG. 4 shows a cross-section of the half round insert 26 illustrating the flat top or exposed surface 30 and the rounded bottom 34.

Side margins 36 are also provided to receive corresponding side margins 38 of the finger board 14 when the finger board 14 is secured to the neck, enclosing the insert 26. The insert 26, finger board 14 and neck 15 may be held together via adhesive. Generally epoxy is the adhesive of choice, however other adhesives which are known to promote an acceptable bond between the materials are contemplated. In one embodiment, the insert 26 is adhered in the groove 28 and the margins 38 of the finger board 14 are adhered to the corresponding margins 36 of the neck. The top 30 of the insert 26 may also be adhered to the underside 32 of the finger board 14. The adherence of the various elements to the insert 26 allows the strength of the carbon insert 26 to support the neck 15, finger board 14 combination, preventing bending, warping or other damage that typically occurs over the life of stringed instrument necks.

Figure 5:
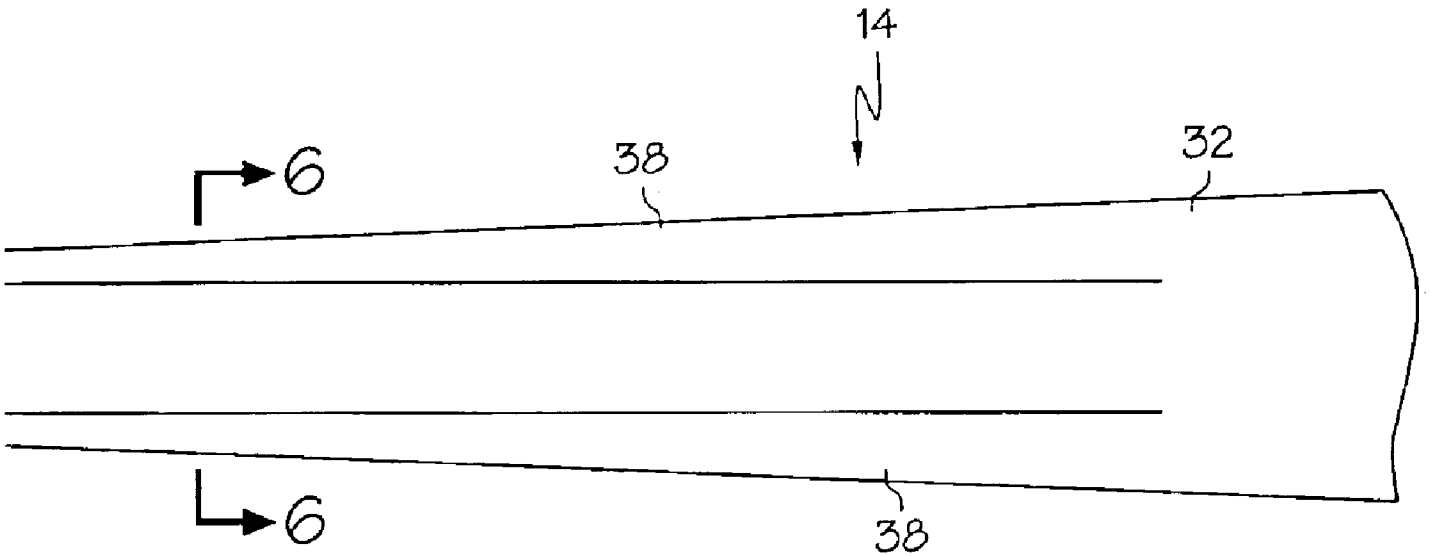
FIG. 5 is a face view of the underside of the finger board.
Figure 6:
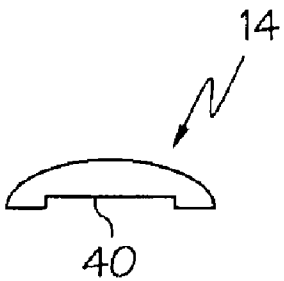
FIG. 6 is a cross-sectional view of the finger board.

FIG. 5 shows the underside of the finger board 14. In one embodiment, the finger board 14 may incorporate a groove 40 to receive the top 30 portion of the insert 26. A cross-section of the finger board 14 is shown in FIG. 6 to better illustrate the groove 40. This assumes that the insert 26 extends above the margins 36 of the neck. If the insert 26 does not extend above the margins 36, the groove 40 is not necessary.

The groove 40 shown is a square groove, shaped to receive the squared top 30 of the insert 26. The grooved fit allows the finger board 14 to be accurately positioned on the neck 15 more securely and allows for greater surface area for adherence to the insert 26. It should be understood that the grooved fit may take other forms, as discussed above.

Figure 7:
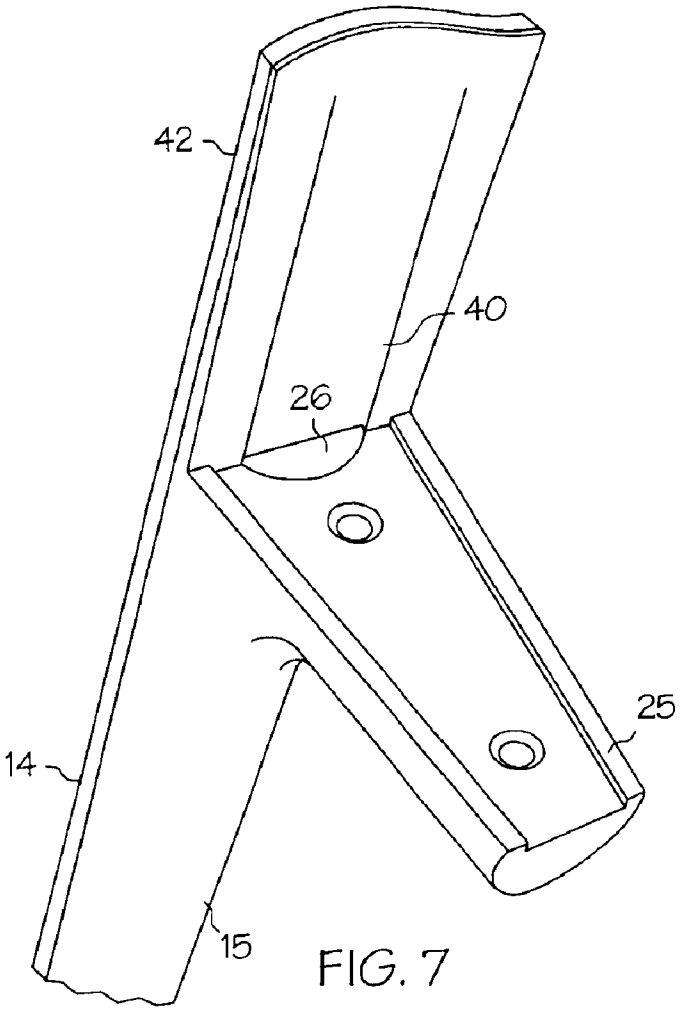
FIG. 7 is a partial perspective view of the neck assembly.

FIG. 7 shows the portion of the neck which connects to the sound box of the guitar via the connecting brace 25. A tongue 42 extends over the sound board 16 of the guitar In this figure, the end of the insert 26 may be seen, enclosed between the neck 15 and the finger board 14.

Figure 8:
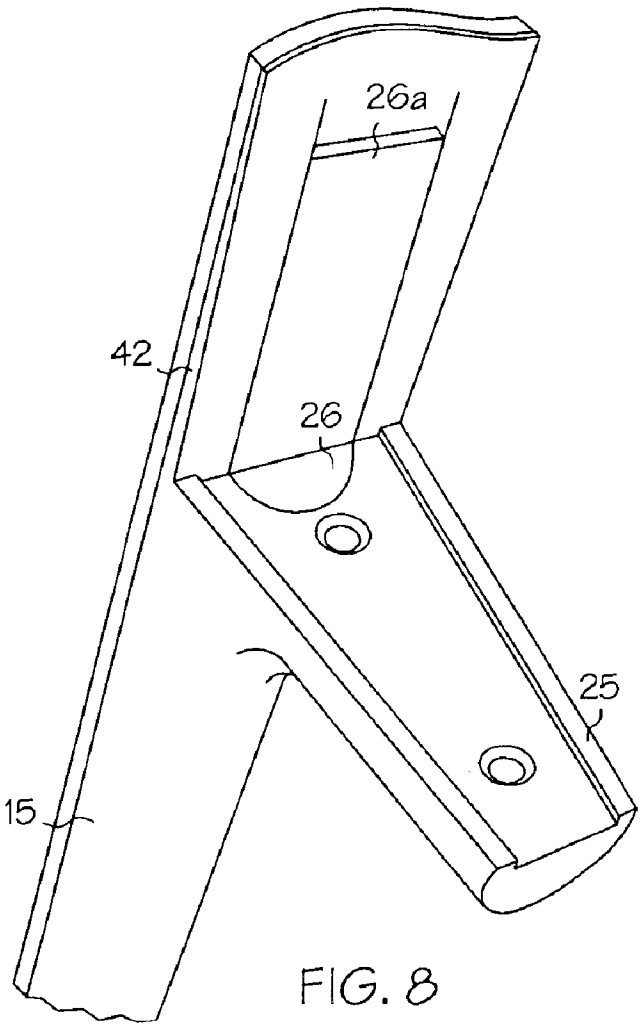
FIG. 8 is a partial perspective view of the neck assembly of a different embodiment.

As shown in FIG. 8, a portion of the carbon insert **26*a* may extend with the tongue 42 provide strength further along the length of the neck. The extent of the extension may vary with embodiments. The invention contemplates embodiments where the extension of the insert 26*a*** extends from 0–100% of the length of the tongue.

The finishing of the neck/finger board combination may be done by conventional means. Since the exposed surfaces are wood, the finished neck has a traditional and convention look, without revealing the use of the carbon insert 26.

The insert 26 is a solid carbon fiber rod of very high strength. The material is a carbon composite with a unidirectional fiber formation. Preferably, the carbon rod has a flexural modulus of about $17\times10^6$ to about $35\times10^6$ psi.

The strength of the insert provide many benefits. These include, but are not limited to, preventing the neck from bowing, or, if a certain amount of bowing is desired, the insert helps to maintain the desired curvature. The construction allows for easier adjustment of the neck to the body of the instrument due to the mating of the two flat surfaces. The neck may be made thinner since the carbon reinforcement is the main strength member and is not dependent on the surrounding wood for additional strength. There is no need to adhere the tongue 42 to the sound board. No periodic adjustments to the neck are needed due to deformation. And, due to the stiffness created in the neck/finger board, the strings remain at a constant level over the finger board.

It is also contemplated that the carbon insert be the only insert within the neck, replacing the need for any other known insert configuration.

Except for the carbon insert running the length of the neck, the materials and methods used are conventional.

Other documents and features incorporated in this application include U.S. Pat. No. 6,060,650, U.S. application Ser. No. 09/852,253 and U.S. application Ser. No. 09/567,145.

In addition to being directed to the embodiments described above and claimed below, the present invention is further directed to embodiments having different combinations of the dependent features described above and/or claimed below.

Every patent, application or publication mentioned above is herein incorporated by reference.

The invention contemplates any combination of the above described elements of the stringed instrument. Therefore, it should be understood that multiple inventions are disclosed herein. The number and description of the inventions are not limited by the claims.

The above examples and disclosure are intended to be illustrative and not exhaustive. These examples and description will suggest many variations and alternatives to one of ordinary skill in this art. All these alternatives and variations are intended to be included within the scope of the claims, where the term "comprising" means "including, but not limited to". Those familiar with the art may recognize other equivalents to the specific embodiments described herein which equivalents are also intended to be encompassed by the claims. Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each single dependent claim format which creates a dependency from a prior antecedent-possessing claim other than the specific claim listed in such dependent claim below (e.g. claim 6 may be taken as alternatively dependent from any of claims 2–5, claim 4 may be taken as alternatively dependent from claim 3; etc.).

What is claimed is as follows:

1. A neck assembly for a stringed musical instrument, the neck assembly comprising a finger board having a certain length, an inner surface and an outer surface and a neck portion having a certain length, an inner surface and an outer surface, the neck assembly further comprising a elongated solid carbon fiber insert positioned between the finger board and the neck portion substantially along their lengths, wherein the solid carbon fiber insert is the only elongated insert between the finger board and the neck portion.

2. The neck assembly of claim 1, wherein the solid carbon fiber insert is a rod comprising unidirectional carbon fibers.

3. The neck assembly of claim 2, wherein the rod has a flexural modulus of about $17\times10^6$ psi or more.

4. The neck assembly of claim 2, the rod having a ½ round cross-section.

5. The neck assembly of claim 2, wherein the neck portion comprises a groove in the inner surface substantially along its length and wherein the solid carbon fiber insert fits within the groove.

6. The neck assembly of claim 2, wherein at least a portion of the finger board is directly adhered to the neck portion.

7. The neck assembly of claim 2, the rod being substantially enclosed within the finger board and the neck portion.

8. The neck assembly of claim 5, wherein the finger board comprises a groove in the inner surface substantially along its length and wherein the solid carbon fiber insert fits within the groove.

9. The neck assembly of claim 5, wherein the groove in the neck portion is rounded.

10. The neck assembly of claim 8, wherein the groove in the finger board is a squared groove.

11. The neck assembly of claim 4, wherein the rounded side of the solid carbon fiber insert faces the neck portion.

* * * * *